US010499687B1

(12) United States Patent
Cook

(10) Patent No.: US 10,499,687 B1
(45) Date of Patent: Dec. 10, 2019

(54) LIGHTER HOLDER ATTACHMENT APPARATUS

(71) Applicant: Aaron M. Cook, Sun City Center, FL (US)

(72) Inventor: Aaron M. Cook, Sun City Center, FL (US)

( * ) Notice: Subject to any disclaimer, the term of this patent is extended or adjusted under 35 U.S.C. 154(b) by 0 days.

(21) Appl. No.: 15/682,639

(22) Filed: Aug. 22, 2017

Related U.S. Application Data

(60) Provisional application No. 62/381,327, filed on Aug. 30, 2016.

(51) Int. Cl.

| | |
|---|---|
| ***A24F 9/14*** | (2006.01) |
| ***A24F 1/30*** | (2006.01) |
| ***A45F 5/00*** | (2006.01) |
| *F23Q 2/34* | (2006.01) |

(52) U.S. Cl.
CPC ..... *A24F 9/14* (2013.01); *A24F 1/30* (2013.01); *A45F 5/00* (2013.01); *F23Q 2/34* (2013.01)

(58) Field of Classification Search
USPC ..... 248/230.1
See application file for complete search history.

(56) References Cited

U.S. PATENT DOCUMENTS 1,660,533 A * 2/1928 Stevens ..... B43K 23/001 24/339
2,578,061 A * 12/1951 Greenblatt ..... A24F 3/00 131/185
3,763,996 A * 10/1973 Shepherd ..... A24F 15/18 206/236
4,146,042 A * 3/1979 Maiorana ..... A24F 5/00 131/185
4,230,224 A * 10/1980 Weeks ..... A24F 15/18 206/87
D283,734 S * 5/1986 Parren ..... D27/153
4,745,661 A 5/1988 Wainscott
4,750,613 A * 6/1988 Kopp ..... B65D 85/109 206/259

(Continued)

OTHER PUBLICATIONS

Bong Lighter Clip, Apr. 29, 2014, imgur.com, p. 1.

(Continued)

*Primary Examiner* — Monica E Millner
(74) *Attorney, Agent, or Firm* — Glenn E. Gold, P.A.; Glenn E. Gold

(57) ABSTRACT

A lighter holder attachment accessory for a water pipe includes an attachment component in the form of an elongated elastic strap of a rectangular configuration and adapted to snugly fit around and thereby securely attach to any diameter size of a tubular stem of the water pipe. The accessory also includes a holder component in the form of a continuous tubular sidewall being closed at a bottom end and open at a top end so as to form an interior compartment for receiving a pocket lighter therein. The holder component also includes an exterior attachment strip on the tubular sidewall such that with the pocket lighter received therein is detachably attachable to the elongated strap of the attachment component and may be temporarily detached therefrom so as to enable the lighter to be used without being removed from the interior compartment of the holder component.

10 Claims, 9 Drawing Sheets

(56) References Cited

U.S. PATENT DOCUMENTS 5,217,294 A * 6/1993 Liston ..... F21L 15/14 224/181
5,366,070 A * 11/1994 Wolov ..... A45C 11/36 206/214
5,412,545 A * 5/1995 Rising ..... A42B 1/244 2/209.13
5,664,673 A * 9/1997 Perry ..... B43K 23/001 206/371
5,682,981 A * 11/1997 Sudborough ..... A44B 15/005 206/349
5,788,479 A 8/1998 Galanos et al.
5,794,767 A 8/1998 Wilson
5,893,496 A * 4/1999 Katz ..... F21L 15/14 224/181
6,196,382 B1 * 3/2001 Lenderman ..... F23Q 2/34 206/37
6,223,891 B1 * 5/2001 Devens ..... A24F 15/18 206/102
6,430,782 B1 * 8/2002 Torres ..... A24F 15/18 206/87
6,530,510 B2 * 3/2003 Ferrari ..... B60R 11/00 131/175
7,464,975 B1 * 12/2008 Cox ..... A45C 11/24 294/138
2007/0034218 A1 * 2/2007 Simon ..... A24F 9/00 131/329
2008/0179362 A1 7/2008 Vaysberg et al.
2008/0248434 A1 10/2008 Wein
2011/0308048 A1 * 12/2011 Raccah ..... H01F 7/0263 24/303
2012/0012723 A1 1/2012 Mansfield

OTHER PUBLICATIONS

Tokeez Lighter Holder, HeadShopStop.com, p. 1.
LighterBuddy, Grasscity.com, pp. 1-3.
#stitchedbysierra, p. 1.
Bong Buddy Lighter Holder Black, SmokinJs, pp. 1-2.
Bowl Band Magnetic Lighter Holder—Small (Rasta), CannaMall.com, pp. 1-2.

* cited by examiner

LIGHTER HOLDER ATTACHMENT APPARATUS

CROSS REFERENCE(S) TO RELATED APPLICATION(S)

This U.S non-provisional patent application claims the benefit of U.S. provisional patent application Ser. No. 62/381,327, having a filing date of Aug. 30, 2016, and is hereby incorporated-by-reference in its entirety.

FIELD OF THE INVENTION

The present invention relates to water pipes, and, more particularly, to a lighter holder attachment accessory for a water pipe.

BACKGROUND OF THE INVENTION

A water pipe is a filtration and cooling device used in conjunction with smoking various types of smoking material. A user places a small quantity of the smoking material in a bowl removably mounted on the exposed end of a down stem which is installed through the wall of a water compartment of the water pipe into a quantity of water therein. Typically, the bottom of the water compartment is shaped to support the water pipe upright on a support surface.

To employ the water pipe, a user places her or his lips within the circular end of a top mouthpiece on a tubular stem extending upright from the water compartment. Concurrently, as the user steadies the water pipe with one hand, the other hand is used to tilt a lighter in front of the bowl and actuate the lighter to produce a flame while the user inhales air from the smoke chamber of the tubular stem to draw the flame into the bowl to ignite the smoking material and also create a partial vacuum in the smoke chamber above the water in the water compartment.

The partial vacuum must be sufficient to not only ignite the smoking material but also to draw the smoke through the downstem, up through the water in the water compartment and into the smoke chamber of the tubular stem leading to the top mouthpiece. Once enough smoke to be inhaled has accumulated in the smoke chamber of the tubular stem, the user removes the bowl from the downstem and inhales the smoke from the smoke chamber.

Most often, a conventional pocket fluid cigarette lighter, easily actuated to produce a flame, is the type that is used. In a group session, typically the water pipe along with the pocket lighter, provided by one of participant for temporary use by the group, are passed together from person to person. However, occasionally, the lighter becomes separated from the water pipe. The lighter is misplaced or even stolen and thus not returned to the owner.

Accessories have been proposed to hold the lighter on the water pipe so that it is passed with the water pipe and only removed from and returned to the water pipe by the one person using the water pipe. Various accessories of this type, such as proposed in US Pub. No. 2012/0012732, appear to be over-engineered for the purpose intended or overly cumbersome to be used effectively on the part of some users.

Accordingly, there remains a need in the art for an innovation that will overcome the deficiencies of past approaches and the problems that remain unsolved.

SUMMARY OF THE INVENTION

The present invention is directed to an innovation that overcomes the deficiencies of the known art and the problems that remain unsolved by providing a lighter holder attachment accessory with two components, one a holder component constructed to hold and remain with the lighter and the other an attachment component constructed to secure about and remain with the water pipe. Both components together constitute a continuing physical reminder to each user of the water pipe and lighter to return the holder component with the lighter to a "home base" designated by the attachment component on the water pipe, before passing the water pipe and lighter to the next user. Also the lighter holder component may have a decorative design that makes it stand out.

In an aspect of the present invention, a lighter holder attachment accessory for a water pipe includes:

- an attachment component in the form of an elongated strap made of an elastic material adapted to snugly fit around and securely attach about any diameter size of a water pipe; and
- a holder component in the form of a body having an interior compartment for receiving a pocket lighter therein and being detachably attachable to the elongated strap of the attachment component such that the holder component with the pocket lighter received therein is temporarily detachable from the elongated strap of the attachment component to enable the lighter to be used without being removed from the interior compartment of the holder component.

In another aspect of the present invention, the attachment component also includes:

- a first attachment material affixed on and covering one opposite side of the elongated strap; and
- a second attachment material attachable to and detachable from the first attachment material and affixed on and covering the other opposite side of the elongated strap.

In another aspect of the present invention, the attachment component also includes first and second attachment strips attachable to and detachable from one another and affixed on opposite sides of the elongated strap.

In another aspect of the present invention, lighter holder attachment accessory for a water pipe includes:

- an attachment component including
  - an elongated strap of a rectangular configuration, made of an elastic material and having a pair of opposite surfaces,
  - a first attachment material affixed on one of the opposite surfaces of the elongated strap, and
  - a second attachment material attachable to and detachable from the first attachment material and affixed on the other of the opposite surfaces of the elongated strap; and
- a holder component including
  - a continuous sidewall of flexible material of a tubular configuration and being closed at a bottom end and open at a top end so as to form an interior compartment for receiving a pocket lighter therein through the open top end, and
  - an attachment strip affixed on an outwardly facing side of the continuous sidewall and being attachable to and detachable from one of the first and second attachment materials on the elongated strap of the attachment component such that the holder component with the pocket lighter received therein is temporarily detachable from the elongated strap of the attachment component to enable the lighter to be used without being removed from the interior compartment of the continuous sidewall of the holder component.

In another aspect of the present invention, the first and second attachment materials are hook and loop material respectively.

In another aspect of the present invention, the first and second attachment materials are magnetic materials attractive to one another.

In another aspect of the present invention, a lighter holder attachment accessory for a water pipe includes:

an attachment component comprising an elongated strap of rectangular configuration, made of an elastic material and having a pair of opposite sides, and at least a pair of strips affixed on said elongated strap, the at least pair of strips including, a first strip and a second strip being attachable to and detachable from one another, the first and second strips respectively located opposite one another and adhered on the corresponding opposite sides of free end portions of the elongated strap so as to enable the elongated strap to snugly and securely be selectively affixed to a backpack, and a holder component comprising, a continuous sidewall of flexible material of a tubular configuration and being closed at a bottom end and open at a top end so as to form an interior compartment for receiving a pocket lighter therein through the open top end, the continuous sidewall having an outwardly projecting member on an outwardly facing side of the continuous sidewall, wherein the member extends longitudinally from the top end to said bottom end and providing a flat platform, and an exterior attachment strip affixed on the flat platform so as to enable the holder component to be detachably attachable to the pair of strips on the elongated strap of the attachment component such that the holder component with the pocket lighter received therein is temporarily detachable from the elongated strap of the attachment component to enable the lighter to be used without being removed from the interior compartment of the holder component.

In another aspect of the present invention, one of the first and second strips has a hook material thereon and the other of the first and second strips has a loop material thereon being attachable to and detachable from the hook material.

In another aspect of the present invention, the first and second strips have magnetic materials thereon being attractive to one another.

In another aspect of the present invention, a retention strip is affixed to an interior surface of the interior compartment at an upper end to enable frictional engagement with the pocket lighter when the pocket lighter is received in the interior compartment to prevent the pocket lighter from ejecting from the holder component during use.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 6. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
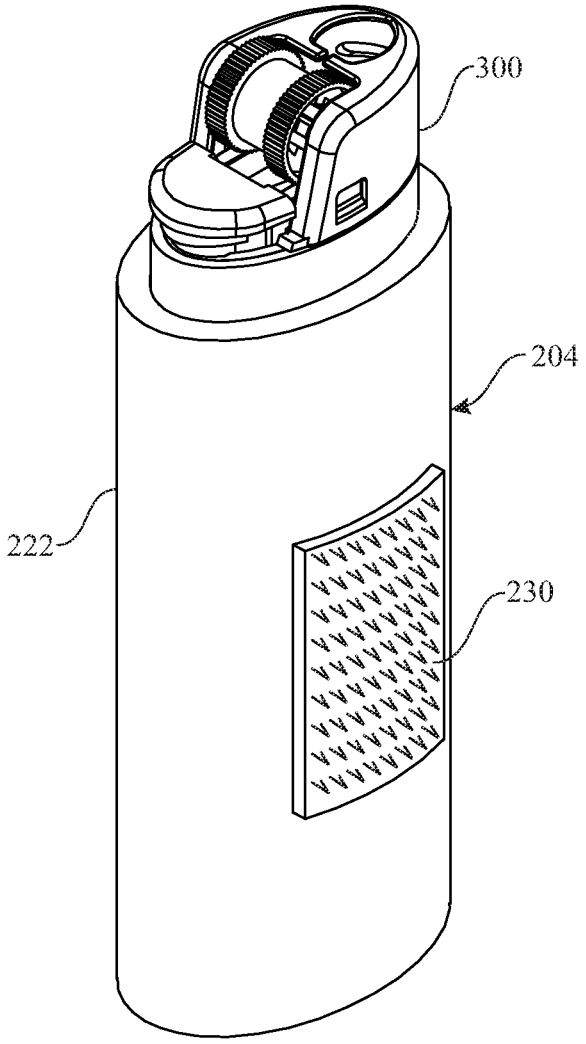
FIG. 4 presents an enlarged isometric view of the holder component of the accessory, originally introduced in FIG. 3, after insertion of the pocket lighter into the holder component of the accessory.
Figure 5:
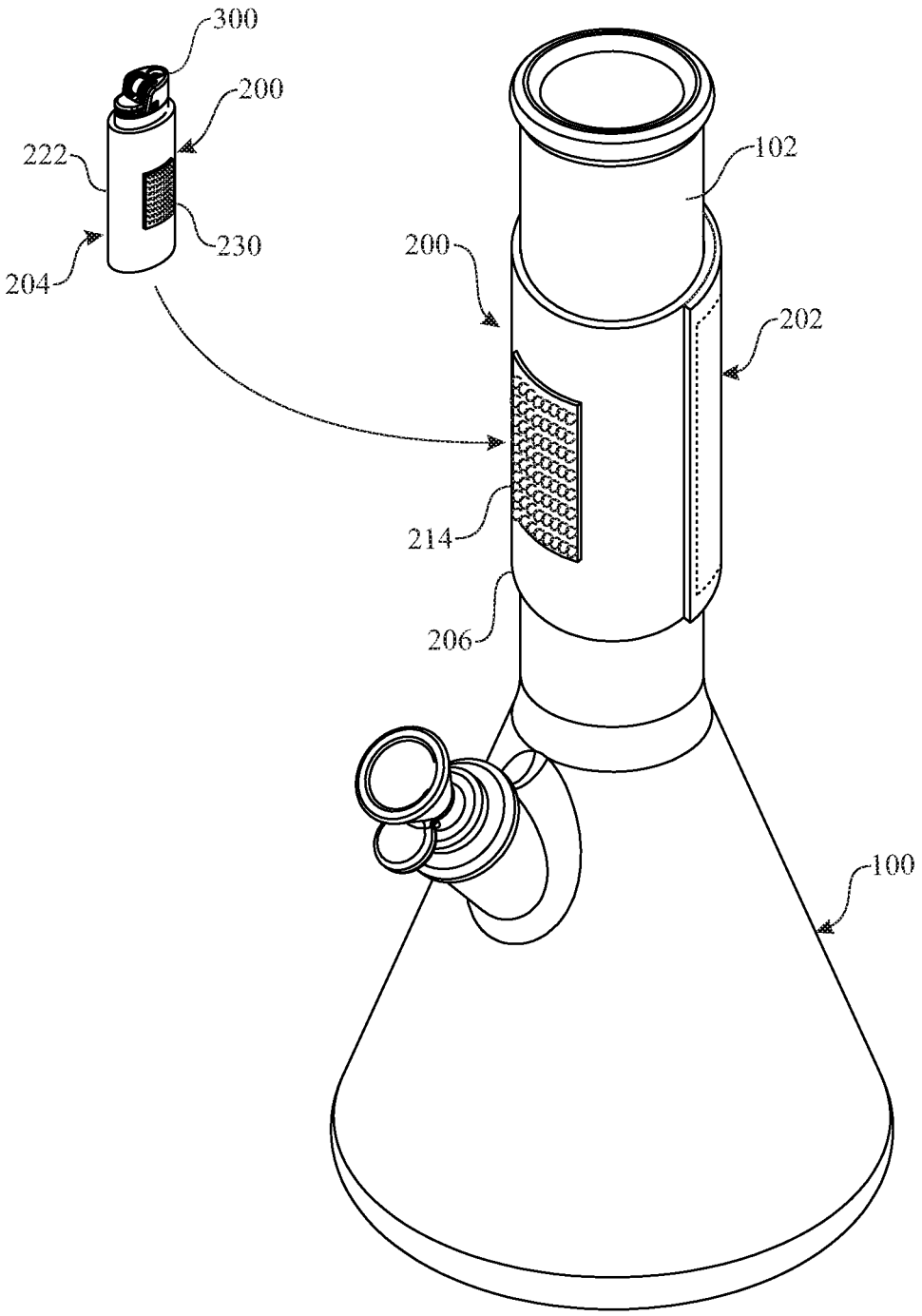
FIG. 5 presents an isometric view of the lighter holder attachment accessory, originally introduced in FIGS. 2 and 4, before attachment of the holder component of the accessory to the attachment component of the accessory installed on the water pipe.
Figure 6:
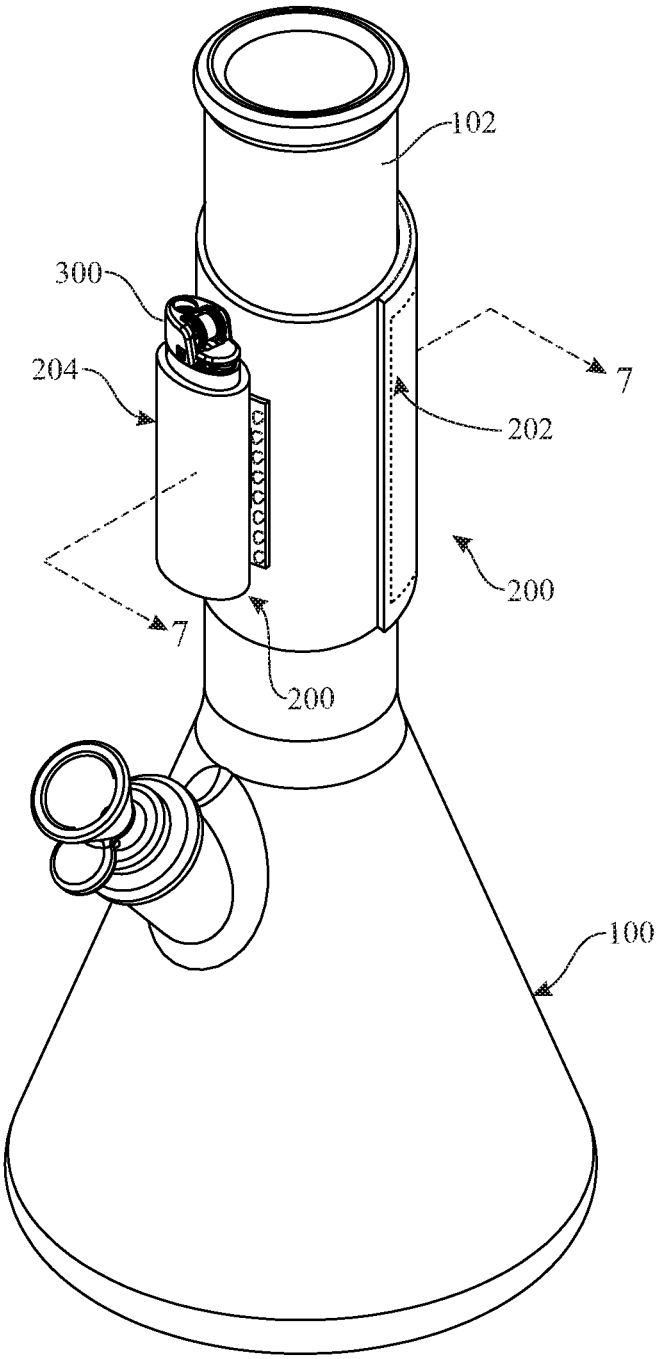
FIG. 6 presents an isometric view of the lighter holder attachment accessory, originally introduced in FIGS. 2 and 4, after attachment of the holder component of the accessory to the attachment component of the accessory installed on the water pipe.
Figure 7:
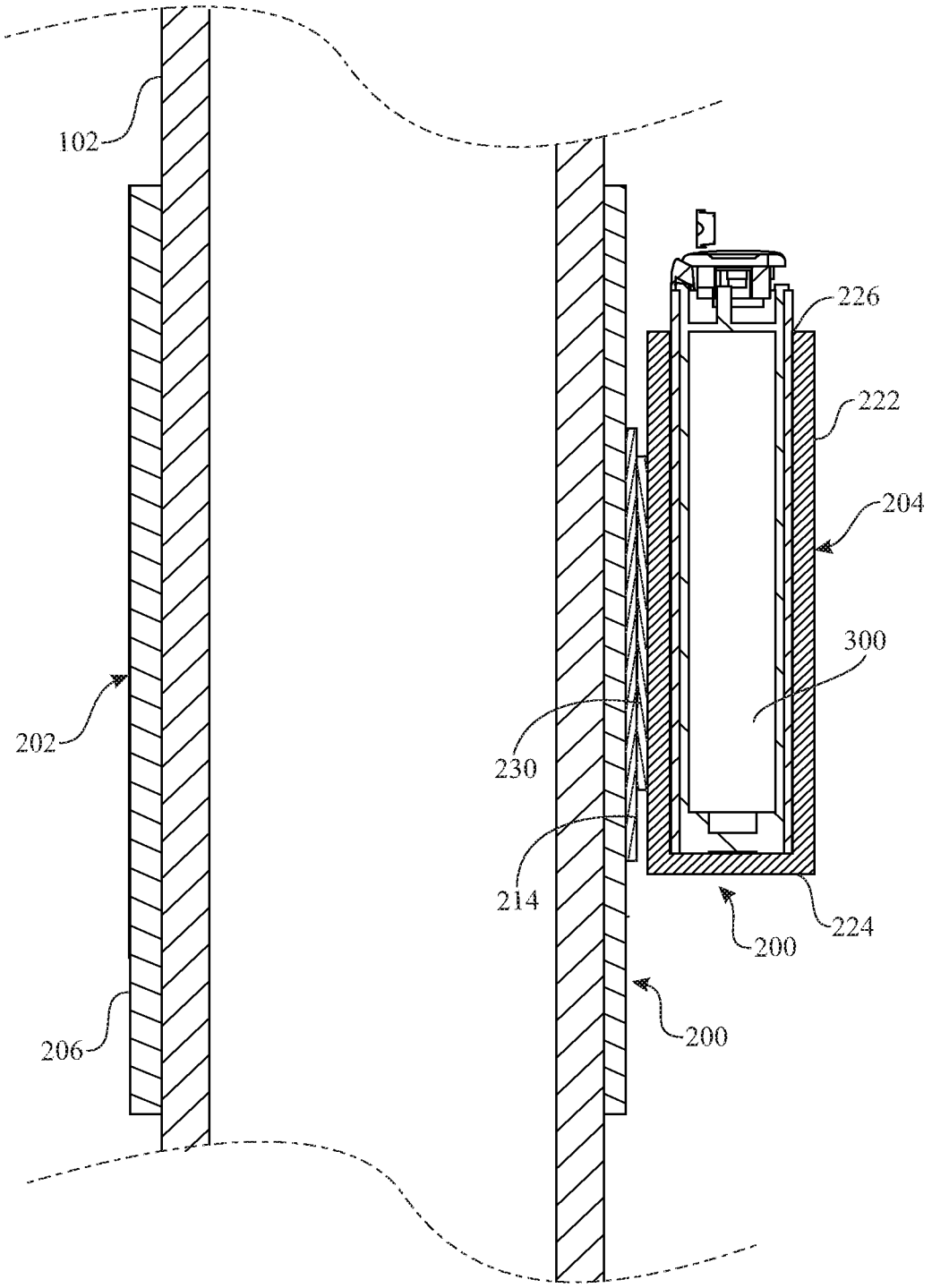
FIG. 7 presents an enlarged cross-section view of the lighter holder attachment accessory installed on the water pipe, as seen along section line 7-7 in FIG. 6.

Referring now to FIGS. 1, 2, 5 and 6, there is illustrated a conventional water pipe, generally designated 100. In FIGS. 3-7 there is shown an exemplary embodiment of a lighter holder attachment accessory, generally designated 200, in accordance with aspects of the present invention. In FIGS. 6 and 7 the accessory 200 is shown as it is generally intended to be deployed on the water pipe 100. Specifically, the accessory 200 may be installed about the tubular stem 102 of the water pipe 100 where it is spaced below a top mouthpiece 104 on the tubular stem 102 and above a water compartment 106 of the water pipe 100 that supports the tubular stem 102. The use of the water pipe 100 is basically as described previously herein in the Background of the Invention section. The accessory 200 primarily affects the handling of a conventional pocket lighter, generally designated 300, that is shown in FIGS. 3-7. From FIGS. 1-7 it can be readily comprehended that the lighter holder attachment accessory 200 basically includes an attachment component 202 and a holder component 204.

Figure 1:
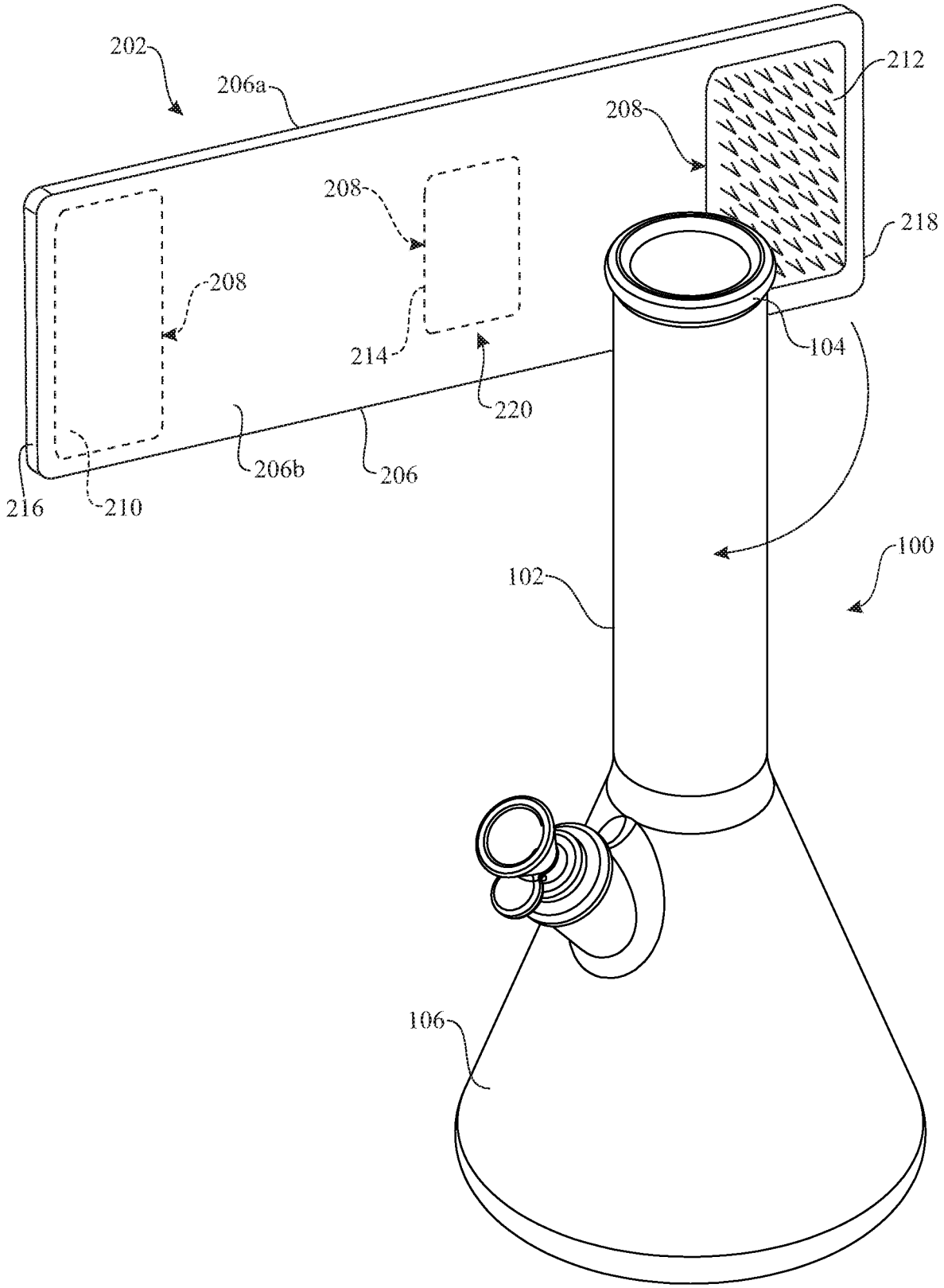
FIG. 1 presents an isometric view of a conventional water pipe and an attachment component of an exemplary embodiment of a lighter holder attachment accessory, in accordance with aspects of the present invention, before installation of the attachment component of the accessory on the water pipe.

Referring again to FIGS. 1 and 2, the attachment component 202 of the lighter holder attachment accessory 200 is respectively shown before and after installation on the water pipe 100. As best seen in FIG. 1, the attachment component 202 includes an elongated strap 206, preferably of a rectangular configuration, made of a suitable elastic material, and having a pair of opposite sides or surfaces 206*a*, 206*b*. The elongated strap 206 has attachment materials affixed on and respectively covering one and the other of the opposite sides or surfaces 206*a*, 206*b*. The attachment materials may be in the form hook and loop materials or magnetically-attractive materials such that the elongated strap 206 is provided by a double-sided hook and loop strap or magnetically-attractive strap. Alternatively, the attachment materials may be a plurality of strips 208 affixed on the elongated strap 206 having the same types of attachment materials thereon. Thus, the elongated strap 206 provides a stretchable band that can be securely fitted around the tubular stem 102 of the water pipe 100.

More particularly, the plurality of strips 208 includes a first strip 210, a second strip 212 and a third strip 214. One of the first strip 210 and second strip 212 has a hook material thereon, while the other of the first strip 210 and second strip 212 has a loop material thereon, or alternatively both have magnetic materials being attractive to one another, such that the first strip 210 and second strip 212 are attachable to and detachable from one another. The first strip 210 and second strip 212 are respectively located proximate to, and affixed such as sewn on, opposite free end portions 216, 218 of the elongated strap 206 on opposite surfaces or sides 206*a*, 206*b* thereof so as to enable the elongated strap 206 to attach to itself at it opposite free end portions 216, 218 and thereby be snugly and securely fitted around any diameter size of the tubular stem 102 of the water pipe 100. The third strip 214 has one of a hook material or a loop material thereon, or alternatively has a magnetic material thereon, such that the third strip 214 is attachable to and detachable from another strip being attractively complementary thereto. The third strip 214 is respectively located proximate to, and affixed such as sewn on, a middle portion 220 of the elongated strap 206 on an outwardly facing side thereof.

Figure 2:
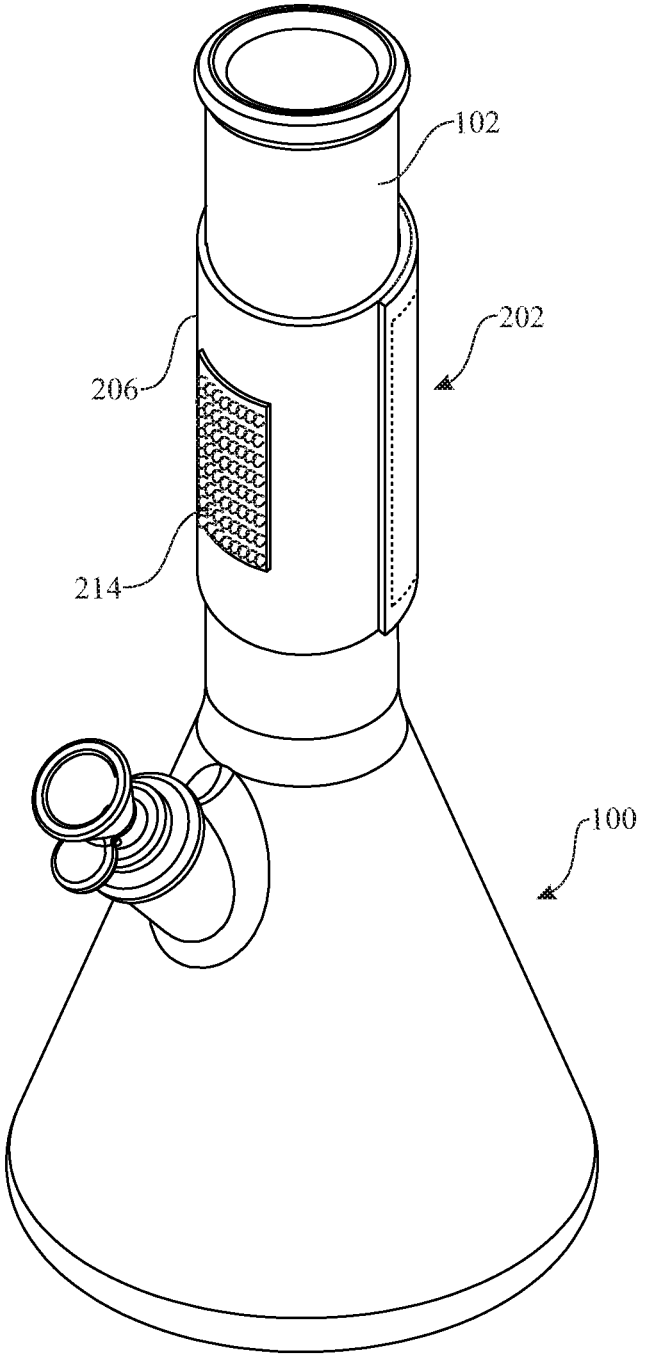
FIG. 2 presents an isometric view of the attachment component of the accessory, originally introduced in FIG. 1, after installation of the attachment component of the accessory on the water pipe.

As seen in FIG. 2, the opposite free end portions 216, 218 of the elongated elastic strap 206 overlap and secure with one another. Although not shown, at the overlap the first and second strips 210, 212 are engaged, and specifically detachably attached, with one another so as to enable the elongated elastic strap 206 to be snugly fitted around and secured to respective tubular stems of different water pipes where the stems may differ in diameter size.

Figure 3:
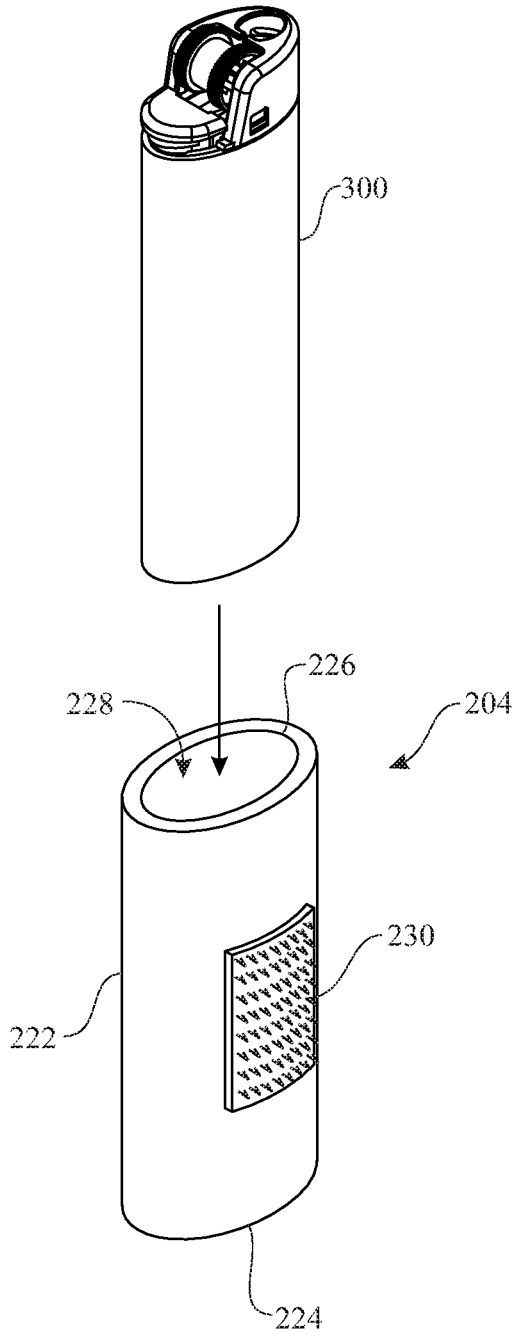
FIG. 3 presents an isometric view of a conventional pocket lighter and a holder component of the exemplary embodiment of the lighter holder attachment accessory before insertion of the pocket lighter into the holder component of the accessory.

Referring now to FIGS. 3 and 4, the holder component 204 of the lighter holder attachment accessory 200 is respectively shown before (FIG. 3) and after (FIG. 4) insertion of the pocket lighter 300 into the holder component 204. More particularly, the holder component 204 has a continuous sleeve or sidewall 222 of flexible material of a tubular configuration. The continuous sidewall 222 is closed at a bottom end 224 and open at a top end 226 so as to form an interior compartment 228 for receiving the pocket lighter 300 therein through the open top end 226. The holder component 204 also has an exterior attachment strip 230 attached on an outwardly facing side of the continuous sidewall 222. The strip 230 either is wrapped around the continuous sidewall 222 or located at one side portion thereof, as best seen in FIGS. 3-5. The strip 230 has the other of a hook material or a loop material thereon, or alternatively has a magnetic material thereon, so as to be detachably attachable to the third strip 214 on the elongated strap 206 of the attachment component 202, as shown in FIGS. 6 and 7, such that the holder component 204 with the pocket lighter 300 received therein may be temporarily detached from the elongated strap 206 of the attachment component 202, as shown in FIG. 5, to enable the lighter to be used without being removed from the interior compartment 228 of the continuous sidewall 222 of the holder component 204.

By way of example only, the elongated strap 206 of the attachment component 202 may be made of a suitable elastic material approximately 5 inches in length and 1½ inches in width. Each of the three strips 210, 212, 218 may be approximately ¾ inch in width and the same length as the width of the elongated strap 206. The elongated elastic strap 206 of the attachment component 202 may be made from double-sided Velcro® hook and loop material. The strips 212, 214, 216 on the elongated elastic strap 206 of the attachment component 202 and the strip 230 of the holder component 204 may be made from Velcro® hook and loop material. The continuous sidewall 222 of the holder component 204 may be made of rectangular piece of silicone material or, alternatively, a rectangular piece of plastic canvas, approximately 2¾×2¼ inches, and a piece of fabric, approximately 3½×4 inches. Hot glue may be applied to one side of the piece of fabric before it is placed over the piece of plastic canvas. Three edges of the extra fabric may be folded over the edges of the piece of plastic canvas and adhered thereto. Hot glue may also be applied along one of the longer edges of the piece of plastic canvas after which the longer edges are brought together and overlapped to form a cylinder. The four edge of extra fabric may be folded and hot glued across one end of the cylinder to form a bottom end of holder component.

To recap, the numerous benefits of the present invention are the following: (1) it makes the process of passing a water pipe and lighter easier when smoking with a group of two or more people; (2) the lighter owner doesn't need to worry as much about someone misplacing or stealing the lighter in a group setting because it will be in the holder component; (3) it is less likely the lighter will be lost since it is indirectly attached to the water pipe while not in use; and (4) it makes smoking from a water pipe a more convenient action since the lighter is accessible right on the water pipe and can easily be put back or reattached right after use.

Figure 8:
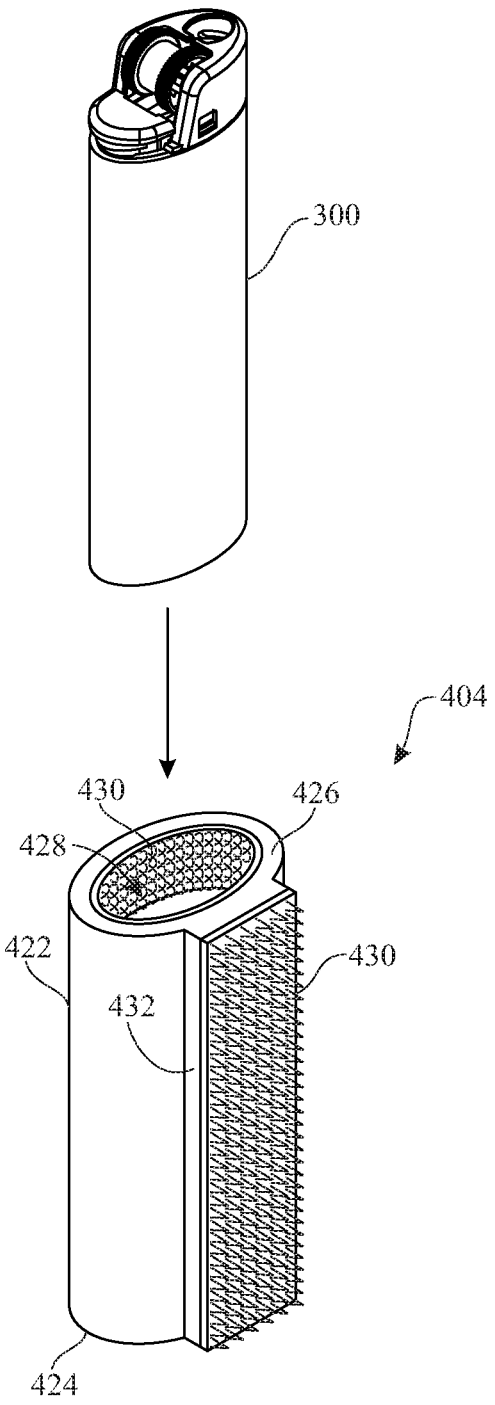
FIG. 8 presents an isometric view of an alternative embodiment of the holder component attachment with a conventional pocket lighter before insertion of the pocket lighter into the holder component of the accessory.
Figure 9:
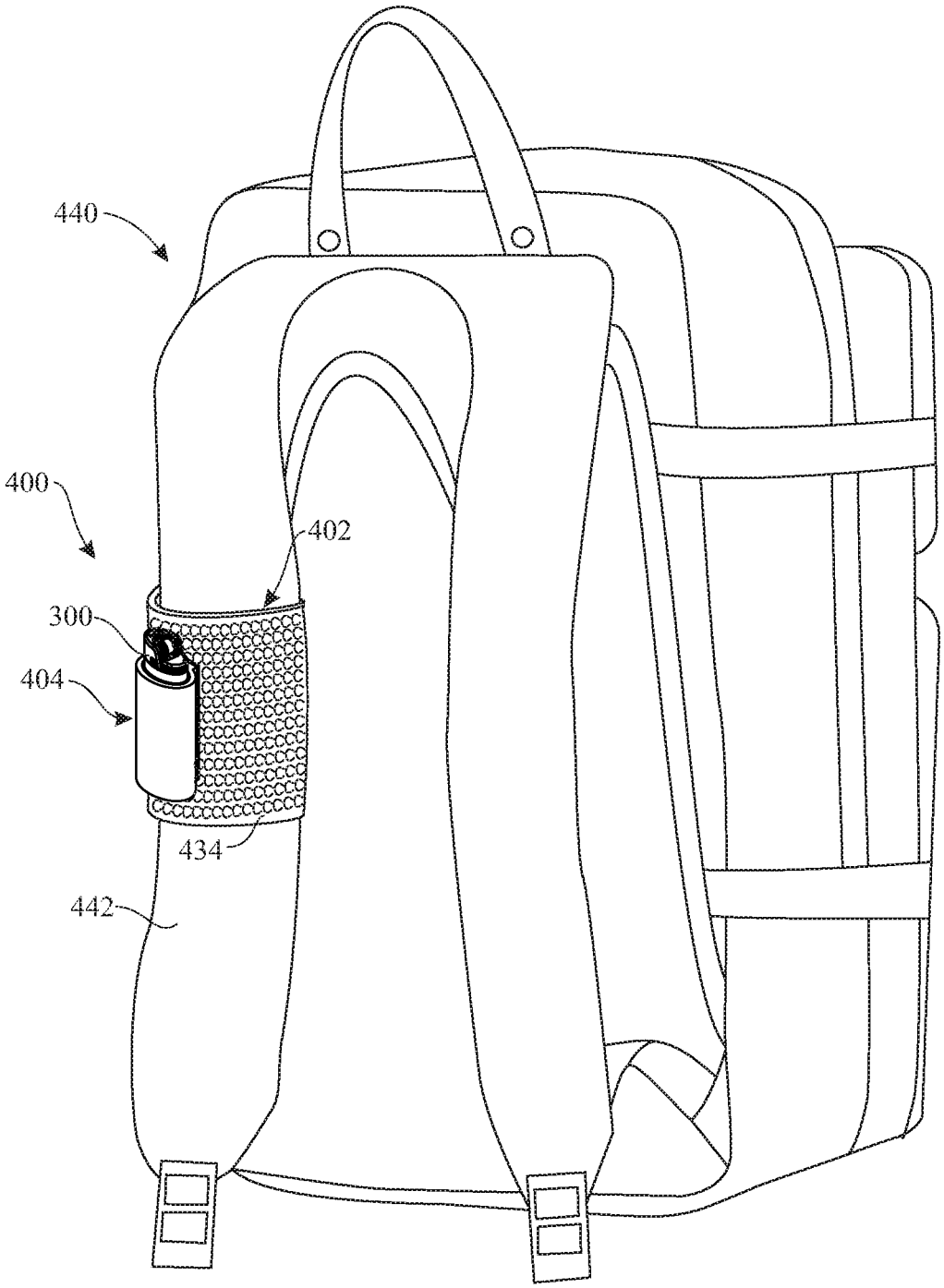
FIG. 9 presents an isometric view of the lighter holder attachment accessory, originally introduced in FIG. 8, after the accessory holder components has been attached to a strap member of a backpack.

Referring now to FIGS. 8 and 9, there is illustrated an alternate exemplary embodiment of the holder component accessory, now generally designated reference numeral 400, in accordance with the aspect of the present invention. Like features of the holder component attachment accessory 200 and 400 are numbered the same except preceded by the numeral '4'. The holder component 404 has a continuous sleeve or sidewall 422 of flexible material of a tubular configuration that is both durable and liquid and fire retardant. The continuous sidewall 422 is closed at a bottom end 424 and open at a top end 426 so as to form an interior compartment 428 for receiving the pocket lighter 300 therein through the open top end 326. An outwardly projecting member 432 is provided on the outwardly (or exterior) facing side of the continuous sidewall 422 and extending longitudinally from the top end 426 of the holder 404 to the bottom end 424 of the holder 404, thereby providing a surface platform wherein an exterior attachment strip 430 may be attached thereon. The strip 430 may also employ alternative means such as, a hook material, loop material, or magnetic material, so as to be detachably attachable to the double sided attachable material 434 on the attachment component accessory 402. The interior compartment 428 proximate the top end 426 of the holder 404 is aligned with a strip of material 430 that provides frictional contact with the lighter 300 when inserted inside of the interior compartment 428. So as to prevent the accidental ejection of the lighter 300 when the holder 404 is not in a vertical position (i.e. when the holder is in an angular position as it is being carried or affixed to the attachment component 402).

As is more clearly shown on FIG. 9, the lighter attachment accessory 400 may be employed and utilized for other intended uses. For example, the attachment component 402 may be made out of a double sided selectively attachable material 434 that is selectively affixed to the shoulder strap 442 of a backpack 440. Likewise, the lighter holder attachment accessory 400 may be generally attached to multiple surfaces, for instance, an interior surface of a car, or a person's belt, desk, grill, etc., or selectively secured around a myriad of objects, such as, back packs, hiking poles, candle fixtures, etc., without departing from the intended scope of the invention.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A lighter holder attachment accessory for a water pipe, the accessory comprising:

an attachment component comprising an elongated strap of a rectangular configuration, constructed from an elastic material and having opposite surfaces, a first attachment material affixed to one of said opposite surfaces of said elongated strap, and a second attachment material attachable to, and detachable from, said first attachment material, and affixed to the other one of said opposite surfaces of said elongated strap; and a holder component comprising a continuous sidewall of flexible stretchable elastic material having a tubular geometry and being closed at a bottom end and open at a top end so as to form an interior compartment for receiving a pocket lighter therein through said open top end, and an attachment strip disposed upon an exterior-facing surface of said continuous sidewall and selectively attachable to, and detachable from, one of said first and second attachment materials affixed to said elongated strap of said attachment component such that said holder component, with the pocket lighter received therein, is temporarily detachable from said elongated strap of said attachment component to enable the lighter to be used without being removed from said interior compartment of said continuous sidewall of said holder component.

2. The accessory of claim 1 wherein said first and second attachment materials are hook material and loop material, respectively.

3. The accessory of claim 1 wherein said first and second attachment materials are magnetic materials attractive to one another.

4. The accessory of claim 1 wherein said attachment strip is one of a hook material and a loop material.

5. The accessory of claim 1 wherein said attachment strip is constructed from a magnetic material.

6. A lighter holder attachment accessory for a water pipe, said accessory comprising:

an attachment component comprising an elongated strap of rectangular configuration, constructed from an elastic material and having a pair of opposite sides, and at least one pair of strips affixed to said elongated strap, the at least one pair of strips including a first strip and a second strip attachable to, and detachable from, one another, said first and second strips adhered to said corresponding opposite sides of free end portions of said elongated strap so as to enable said elongated strap to be securely selectively affixed about a continuous cylindrical surface of a water pipe tubular stem, and a holder component comprising a continuous sidewall of stretchable elastic material having a tubular configuration, and closed at a bottom end and open at a top end thereof so as to form an interior compartment for receiving a pocket lighter therein through said open top end, said open top end smaller than said pocket lighter such that said continuous sidewall has to be stretched to accommodate said pocket lighter within said interior compartment, said continuous sidewall having an outwardly projecting member extending from an exterior surface thereof, said outwardly projecting member extending longitudinally from said top end to said bottom end and defining a flat platform, and an exterior attachment strip disposed upon said flat platform so as to enable said holder component to be releasably attached to said pair of strips on said elongated strap of said attachment component such that said holder component, with said pocket lighter received therein, is temporarily detachable from said elongated strap of said attachment component to enable the lighter to be used without being removed from said interior compartment of said holder component.

7. The accessory of claim 6 wherein one of said pair of strips has a hook material provided thereon and the other one of said first and second strips has a loop material provided thereon, the loop material being attachable to, and detachable from, said hook material.

8. The accessory of claim 6 wherein said first and second strips incorporate respective magnetically-attracted materials.

9. The holder component of claim 6 further comprising a retention strip affixed to an interior surface of said interior compartment at an upper end thereof to enhance frictional engagement with said pocket lighter upon insertion of the pocket lighter into said interior compartment.

10. A lighter retaining accessory selectively attachable to a tubular stem portion of a water pipe, the lighter retaining accessory comprising:

an attachment component releasably-attachable about a cylindrical exterior surface of the tubular stem portion of the water pipe, the attachment component comprising an elongated elastic stretchable panel of material having opposite inner-facing and outer-facing panel surfaces, and opposite first and second free ends, a first patch of a first hook-and-loop attachment system material disposed upon said outer-facing panel surface proximate said first free end, the first patch being a first one of a hook and a loop type material, a second patch of a first hook-and-loop attachment system material disposed upon said inner-facing panel surface proximate said second free end, the second patch being a second one of a hook and a loop type material, and a first patch of a second hook-and-loop attachment system material disposed upon said outer-facing panel surface intermediate of said first and second free ends, wherein, upon stretching and wrapping said attachment component about the cylindrical exterior surface of the water pipe tubular stem with said inner-facing panel surface in direct contact with said cylindrical exterior surface, said first and second patches of hook-and-loop attachment system material may be overlapped to releasably-attach said elongated elastic stretchable panel of material about said tubular stem in a secure manner; and a lighter-retaining component for selectively retaining a lighter therein via frictional engagement with said lighter, the lighter-retaining component comprising a contiguous cylindrical sidewall having opposite interior and exterior sidewall surfaces and an open upper end, a closed lower end, and a second patch of a second hook-and-loop attachment system material disposed upon said exterior cylindrical sidewall surface, said second patch of said second hook-and-loop attachment system material releasably-attachable to said first patch of said second hook-and-loop attachment system material to enable and facilitate selective attachment and detachment of said lighter-retaining component to said attachment component, wherein during use, the contiguous cylindrical sidewall and the closed lower end of the lighter-retaining accessory, together, define a stretchable elastic lighter-retaining pocket for frictionally retaining the lighter within the lighter-retaining component during said selective attachment and detachment of the lighter-retaining component to the attachment component.

* * * * *